US005443865A

United States Patent [19]

Tisdale et al.

[11] Patent Number: 5,443,865

[45] Date of Patent: Aug. 22, 1995

[54] METHOD FOR CONDITIONING A SUBSTRATE FOR SUBSEQUENT ELECTROLESS METAL DEPOSITION

[75] Inventors: Stephen L. Tisdale, Vestal; Alfred Viehbeck, Stormville, both of N.Y.

[73] Assignee: International Business Machines Corporation, Armonk, N.Y.

[21] Appl. No.: 859,594

[22] Filed: Mar. 23, 1992

Related U.S. Application Data

[63] Continuation of Ser. No. 626,127, Dec. 11, 1990, abandoned.

[51] Int. Cl.[6] ..... B05D 1/00

[52] U.S. Cl. ..... 427/304; 427/305; 427/306

[58] Field of Search ..... 427/304, 305, 306

[56] References Cited

U.S. PATENT DOCUMENTS

| | | | |
|---|---|---|---|
| 3,011,920 | 12/1961 | Shipley | 106/1.25 |
| 3,488,166 | 1/1970 | Kovac | 204/30 |
| 3,589,916 | 6/1971 | McCormack . | |
| 3,758,332 | 9/1973 | Dinella et al. . | |
| 3,772,056 | 11/1973 | Polichette et al. . | |
| 3,772,078 | 11/1973 | Polichette et al. . | |
| 3,791,848 | 2/1974 | DeAngelo . | |
| 3,808,028 | 4/1974 | Lando . | |
| 3,865,623 | 2/1975 | Allen, Jr. et al. . | |
| 3,954,570 | 5/1976 | Shirk et al. . | |
| 3,962,496 | 6/1976 | Leech . | |
| 3,982,045 | 9/1976 | Kukanskis . | |
| 3,993,491 | 11/1976 | Feldstein . | |
| 3,993,799 | 11/1976 | Feldstein . | |
| 3,993,801 | 11/1976 | Feldstein . | |
| 4,006,047 | 2/1977 | Brummett et al. . | |
| 4,039,714 | 8/1977 | Roubal et al. . | |
| 4,048,354 | 9/1977 | Feldstein . | |
| 4,078,096 | 3/1978 | Redmond et al. . | |
| 4,086,128 | 4/1978 | Sugio et al. . | |
| 4,112,139 | 9/1978 | Shirk | 427/306 |
| 4,136,216 | 1/1979 | Feldstein . | |
| 4,150,171 | 4/1979 | Feldstein . | |
| 4,181,760 | 1/1980 | Feldstein . | |
| 4,222,778 | 9/1980 | Nuzzi et al. . | |
| 4,239,538 | 12/1980 | Feldstein . | |
| 4,261,800 | 4/1981 | Beckenbaugh et al. . | |
| 4,281,034 | 7/1981 | Narayan . | |
| 4,293,592 | 10/1981 | Morishita et al. . | |
| 4,298,636 | 11/1981 | Kunzig | 427/306 |
| 4,305,997 | 12/1981 | Feldstein . | |
| 4,321,285 | 3/1982 | Feldstein . | |

(List continued on next page.)

FOREIGN PATENT DOCUMENTS

| | | |
|---|---|---|
| 374487 | 6/1990 | European Pat. Off. . |
| 1338491 | 11/1973 | United Kingdom . |

OTHER PUBLICATIONS

L. M. Miall "A New Dictionary of Chemistry" Interscience Publishers Inc. 1961, p. 466

"Low Cost Seeding of Polyimide For Electroless Metal Deposition" IBM Technical Disclosure Bulletin, vol. 32, No. 5B Oct. 1989 pp. 4–6.

The Merch Index, An Encyclopedia of Chemicals, Drugs & Biologicals. 10th Ed. Martha Windholz, Editor, Published by Merch & Co. Inc. Rahway, N.J. 1983 p. 473 no month, 1983.

D. C. Green et al. "Electrically Conductive TTF Polymers" IBM Tech. Discl. Bulletin, vol. 20, No. 7, Dec. 1977, pp. 2865–2867.

*Primary Examiner*—Shrive Beck
*Assistant Examiner*—Vi Duong Dang
*Attorney, Agent, or Firm*—Daniel P. Morris

[57] ABSTRACT

Substrates are activated for subsequent metallization by contacting the substrate with a electrolyte in which reducing agents which are electrochemically generated in the electrolyte. The reducing agents are sorbed by the substrate which is contacted with a seeding medium to dispose on the substrate seed, preferably palladium seed for subsequent electroless and electrolytic metallization.

33 Claims, 1 Drawing Sheet

U.S. PATENT DOCUMENTS 4,325,991 4/1982 Donovan, III et al. .
4,399,489 8/1983 Ross .
4,402,998 9/1983 Kumagai et al. .
4,424,095 1/1984 Frisch et al. .
4,448,804 5/1984 Amelio et al. .
4,448,808 5/1984 Pearl ..... 427/290
4,511,757 4/1985 Ors et al. .
4,554,182 11/1985 Bupp et al. .
4,563,371 1/1986 Sirinyan et al. .
4,574,031 3/1986 Dorey, II et al. .
4,582,564 4/1986 Shanefield et al. .
4,594,311 6/1986 Frisch et al. .
4,597,988 7/1986 Kukanskis et al. .
4,601,916 7/1986 Arachtingi .
4,624,912 11/1986 Zweifel et al. .
4,628,022 12/1986 Ors et al. .
4,661,384 4/1987 Sirinyan et al. .
4,666,735 5/1987 Hoover et al. .
4,666,739 5/1987 Roubal .
4,668,354 5/1987 Levy ..... 204/130
4,692,360 9/1987 Manring ..... 427/443.1
4,701,350 10/1987 Lindsay .
4,710,310 12/1987 Shinozaki et al. .
4,710,403 12/1987 Krause ..... 427/304
4,719,145 1/1988 Neely .
4,728,560 3/1988 Sirinyan et al. .
4,734,299 3/1988 Matuzaki et al. .
4,737,446 4/1988 Cohen et al. .
4,743,645 5/1988 Harris et al. .
4,748,104 5/1988 Ferrier et al. .
4,750,092 6/1988 Werther .
4,752,529 6/1988 Manring ..... 427/306
4,764,401 8/1988 Sirinyan et al. .
4,774,122 6/1988 Adler .
4,774,157 9/1988 Manring .
4,775,449 10/1988 Dumas ..... 427/306
4,775,557 11/1988 Bastenbeck et al. .
4,782,007 11/1988 Ferrier ..... 427/98
4,784,880 11/1988 Coplan et al. .
4,795,693 1/1989 Ors et al. .
4,810,333 3/1989 Gulla et al. .
5,021,129 6/1991 Arbach ..... 204/15
5,045,159 9/1991 Goldberg ..... 204/59 R
5,135,779 8/1992 Viehbeck ..... 427/306

METHOD FOR CONDITIONING A SUBSTRATE FOR SUBSEQUENT ELECTROLESS METAL DEPOSITION

This is a continuation of application Ser. No. 07/626,127, filed Dec. 11, 1990, abandoned.

CROSS REFERENCE TO RELATED APPLICATIONS

Copending U.S. application Ser. No. 07/290,486 entitled "Method For Conditioning Organic Polymeric Materials" to Viehbeck et al. filed on Dec. 23, 1988 describes certain organic polymeric materials which are capable of reversibly accepting or donating electrons from a reducing entity. The redox sites in the polymer accept electrons and, as a result, a change in the properties of the polymer occurs. This change is useful in modifying or etching the polymeric material. The material can be modified by incorporation of metallic seeds into the material at a controlled depth. The seeds are incorporated by interaction of cations of the metals with the redox sites in the polymer, which cause the reduction of the cations to form the neutral metallic seeds. The seeds are incorporated by interaction of cations of the metals with the redox sites in the polymer, which cause the reduction of the cations to form the neutral metallic seeds. Subsequent exposure of the polymer material containing the seeds to an electroless bath causes further deposition of metal having the desirable characteristic of good adhesion to the polymeric material. Etching of the polymeric material can be carried out as a result of an increase in the solubility of the polymer in aprotic solvents when its redox sites have accepted electrons. The solubility allows openings to be etched in certain areas of the polymeric material that have been reduced, leaving other areas uncharged.

FIELD OF THE INVENTION

The present invention is concerned with disposing zero valence atoms at the surface of a substrate, preferably catalytic metal atoms which are useful for subsequent electroless metal deposition on the zero valence atoms. More preferably, the present invention relates to treating the substrate with an anionic species which is sorbed at the substrate surface. Thereafter, the surface is exposed to cations which are capable of receiving electrons from the sorbed anionic species which reduces the cation to a reduced valence state at the surface of the substrate.

BACKGROUND OF THE INVENTION

In the manufacture of semiconductor chips and semiconductor chip packaging substrates, semiconducting and dielectric materials are employed. In a semiconductor chip, conductive circuit patterns are provided on the semiconductor materials and on dielectric materials disposed on the semiconducting material. In semiconductor chip packaging substrates, conductive circuit patterns are provided on dielectric materials which are typically glasses, ceramics, polymeric materials and combinations thereof. In order to electrolessly plate metal on substrates formed of these materials, it must be seeded or catalyzed prior to the deposition of the electroless metal thereon.

Among the more widely employed procedures or catalyzing a substrate is the use of a stannous chloride sensitizing solution and a palladium chloride activator to form a layer of metallic palladium particles thereon. For instance, one method of catalyzing a dielectric substrate is exemplified by U.S. Pat. No. 3,011,920 which includes sensitizing a substrate the first treating it with a solution of colloidal metal, then accelerating the catalyst by treatment with a reagent to remove unreactive regions from the colloids on the sensitized dielectric substrate, and electrolessly depositing a metal coating on the sensitized substrate, for example, with copper from a solution of copper salt and a reducing agent.

Unlike the prior art, the present invention does not use a stannous chloride sensitizing solution. The present invention first treats the surface with a pretreatment which disposes at the surface of the substrate a species, preferably an anionic species, capable of transferring electrons. The surface of the substrate is then contacted with the solution of another species preferably a metal cation or a metal cation-containing compound. The species disposed on the surface is capable of transferring an electron to the species in solution. When the electron transfers, metal of the compound in solution is disposed on the surface of the substrate in reduced form, preferably in the zero valence state of the atom corresponding to the species in solution. Preferably, the species in solution is a metal cation or a metal complex which in the zero valence state is catalytic to the electroless deposition of metal thereon.

U.S. Pat. No. 4,261,800 describes a method For electroless deposition of metal onto a nonconducting substrate, such as polyimide. A reducing agent solution of hydrazine or substituted hydrazine is deposited onto a surface of the substrate. The reducing agent in the solution is either absorbed onto the surface or remains on the surface. The surface is selectively exposed to ultraviolet radiation causing decomposition of the hydrazine. The surface is contacted with a solution containing an activating metal species. The irradiated parts of the surface are incapable of reducing the activating metal species. In the nonirradiated part of the surface, the activating metal is deposited on the surface which is useful as seed For subsequent electroless deposition. The activating metal species can be platinum, or palladium.

U.S. Pat. No. 4,112,139 describes the metallization of polyimide surfaces by exposing the surface to a substituted or unsubstituted hydrazine. The treated surface is photolytic, which can be selectively desensitized by exposure to U.V. light. When the treated substrate is placed in a palladium chloride solution, palladium metal is disposed on the unexposed regions and no palladium is disposed on the exposed regions.

Substituted and unsubstituted hydrazines are toxic and highly explosive chemicals which therefore are unsuitable for large scale manufacture of electrical components. In contradistinction, the compounds, sorbed at the surface to be metallized according to the present invention, are not highly toxic and are not highly explosive.

It is an object of this invention to provide a reducing agent at the surface of a substrate which is free of hydrazines.

U.S. Pat. No. 4,775,449 describes improving the adhesion of metal applied on a polyimide surface by treating the surface with an adhesion promoting compound containing a nitrogen-oxygen moiety. It is suggested that the compound acts as a reducing agent and is incorporated into the polyimide either along the diamine-based chain portion or into the dianhydride based portion of the polyimide. After treating the surface with the adhesion-promoting compound, the substrate may be thoroughly rinsed with distilled water or a methanol solution and then activated For plating by methods well-known in the art.

In contradistinction, the compounds of the present invention which are applied to a substrate do not chemically alter the substrate surface. According to the present invention, a species, preferably an anionic species, is provided at the surface of the substrate. This species does not chemically alter the substrate, but is capable of transferring an electron to a species in solution resulting in the disposition on the surface of the substrate a reduced form of the species in solution.

It is another object of the present invention, to provide a reducing agent at the surface of the substrate which does not chemically alter the substrate.

U.S. Pat. No. 4,782,007 describes a process for making printed circuit boards using aqueous alkaline strippable resist. The solution to strip the resist preferably includes, a reducing agent such as hydrazine, alkali, hypophosphite, sodium borohydride, dimethyl amino borane, or other like reducing agents, which appear to have the affect of improving the subsequent electroless deposit on the catalyzed substrate either by mininizing removal of the catalyst during stripping or stabilizing catalysis or exposing additional catalytic surface. Prior to application of the stripping solution containing the reducing agent, the resist-patterned substrate is treated with the solution which deposits a species catalytic to electoless deposition.

U.S. Pat. No. 3,488,166 to Kovac et al. describes a method for activating a formaldehyde containing plastic substrate for subsequent metallization by polymerizing on the surface of the plastic substrate a coating of a formaldehyde compound selected from the group consisting of urea formaldehyde plastic, phenolic formaldehyde plastic, melamine formaldehyde plastic and arylsulfonamade-formaldehyde resins. The formaldehyde surface coating is a reducing agent for a metal salt. The formaldehyde coating is sensitized by being contacting with a reducible catalytic metal salt solution for a time to chemically bond the metal constituent of the salt to the coating. The Kovac et al. method requires that the formaldehyde coating be deposited on a formaldehyde containing substrate. In contradistinction, according to the present invention, there is no such requirement.

U.S. Pat. No. 4,448,804 to Amelio et al. describes a method for metallizing a nonconductive surface wherein the surface is treated with a quaternary phosphonium or quaternary ammonium group which provides a positive charge to the surface. Thereafter, the surface is treated with a seeding solution containing tin chloride and palladium chloride which forms a solution of negatively charged colloidal particles containing Pd and Sn surrounded by chloride ions. The negatively charged particles are electrostatically attracted to the positively charged surface. The substrate is treated with HCl to remove Sn leaving Pd on the surface which is catalytic to subsequent electroless plating. In contradistinction, the present invention does not require a charged palladium/tin colloid solution.

U.S. Pat. No. 4,752,529 described depositing within films, which do not have to be electroactive, metal interlayers by reacting metal ions, for example Pd ions, diffusing from a solution in contact with one side of the film with a solution of reducing agent diffusing from a solution in contact with the opposite side of the film. The reducing agent solution can be $NaBH_4$ in a polar aprotic solvent. This requires that the reducing agent be able to diffuse through the film. In contradistinction, the method of the present invention does not require the reducing agent to be able to diffuse through the substrate.

U.S. Pat. No. 4,668,354 describes disposing a rectal interlayer within a polymeric film. One side of the film is on a cathode, the other side of the film is contacted with a metal cation containing solution. An electroactive transfer compound within the film picks up an electron at the cathode, diffuses into the film where it transfers electrons to metal cations diffusing from the other side of the film to deposit zero valence metal atom in the film. This requires that the reducing agent be able to diffuse through the film. In contradistinction, the method of the present invention does not require the reducing agent to be able to diffuse through the substrate.

According to one aspect of the present invention, a substrate is immersed in an electrolytic cell within which is generated a reducing agent which is sorbed at the substrate surface. The substrate is subsequently contacted with a solution containing a species preferably a metal cation, which is reduced at the substrate surface, most preferably to the zero valence state of the cation.

It is another objective of the present invention to condition the surface of a substrate for subsequent electroless metal deposition by providing at the surface a chemical reducing agent which reduces a species in solution to dispose on the surface a form of the species in solution in a reduced valence state.

It is another more particular object of the present invention to electrochemically generate the reducing agents.

It is another more particular object of the present invention to generate a reducing agent by reacting a species with an alkali metal to produce an anionic form of the species.

SUMMARY OF THE INVENTION

A broad aspect of the present invention is immersing a substrate in a solution containing a reducing agent either chemically or electrochemically generated in the solution. The reducing agent is sorbed at the substrate surface. The substrate is exposed to a second chemical species capable of receiving an electron from the sorbed reducing agent, thereby disposing at the surface of the substrate a form of the second species in a reduced valence state.

Another broad aspect the present invention is a method for conditioning at least one surface of a substrate by providing at the surface an anionic chemical reducing agent, thereafter the treated surface is contacted with a solution that contains cations or metal complexes which are capable of receiving electrons from the anionic chemical reducing agent to thereby reduce the cations or metal complexes to atoms having a less positive oxidation state, most preferably to the zero oxidation state.

In a more particular aspect of the present invention, the cations are metal cations.

In another more particular aspect of the present invention, another metal is electrolessly deposited upon the zero oxidation state metal atoms.

These and other objects, features and advantages of the present invention will be readily apparent to those of skill in the art from the following specification and the appended drawings.

DETAILED DESCRIPTION OF THE PREFERRED EMBODIMENT

Figure 1:
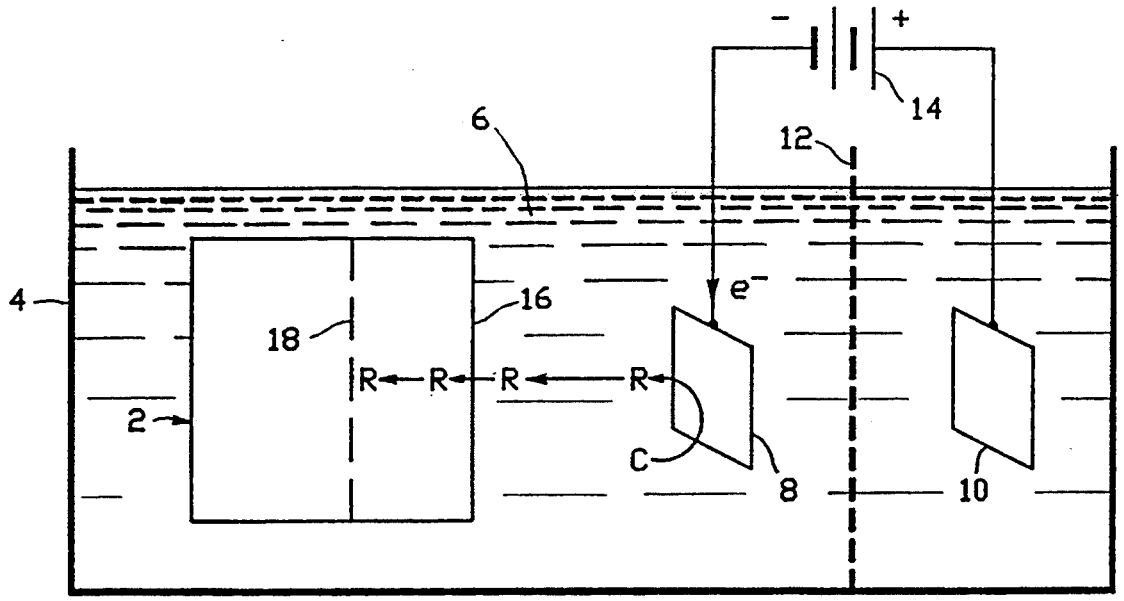
FIG. 1 schematically shows the generation of a reducing agent in solution and the disposition of the reducing agent at the surface of a substrate.

FIG. 1 shows substrate 2 in container 4 which contains an electrolyte solution 6. Immersed in the solution is a cathode 8 and an anode 10. The anode and cathode are preferably in separate compartments separated by an appropriate membrane to prevent reduced species generated at cathode 8 from mixing with oxidized species generated at anode 10. Membrane 12 can be those commonly used in the art such as a porous sintered glass flit, an agar plug, a salt bridge or a semipermeable membrane. An example of a semipermeable membrane is a Nafion® DuPont which is a cationic exchange membrane. Cathode 8 is negatively biased in respect to anode 10 by means of voltage source 14. Solution 6 contains a compound C and electrolyte salt. The compound C is electrochemically reduced at the surface of cathode 8 to reducing agent R. A potentiostatic or galvanostatic mode can be used to generate the reducing agent R. The compound C picks up an electron at cathode 8 and becomes reducing agent R. The number of electrons required to generate the reduced species R can be one or more per molecule on the compound being reduced. The reduced state may not necessarily be an anionic species but could be neutral or cationic provided the redox potential requirements for the process are met. A requirement for the reducing agent is that its oxidation potential is negative to that of the species to be deposited at the surface 16 of the substrate 2.

In the first step of the process, the reducing agent R diffuses from the cathode 8 to the surface 16 of substrate 2. The amount of reducing agent uptake by the substrate is affected by the microstructure at the substrate surface including crystallinity and in the case of a polymeric substrate cross-linking, type of solvent, reducing agent concentration and electrolyte species. The reducing agent is absorbed into the surface 16 to a depth of penetration 18. Where the reducing agent R is an anion the solution 6 contains counter ions which are cations which are not disposed to receive the electron from the anionic species. The counter ions provide charge neutrality. The anion and counter ion are absorbed into the surface 16 of the substrate 2 to the penetration depth to provide charged neutrality in that region.

Figure 2:
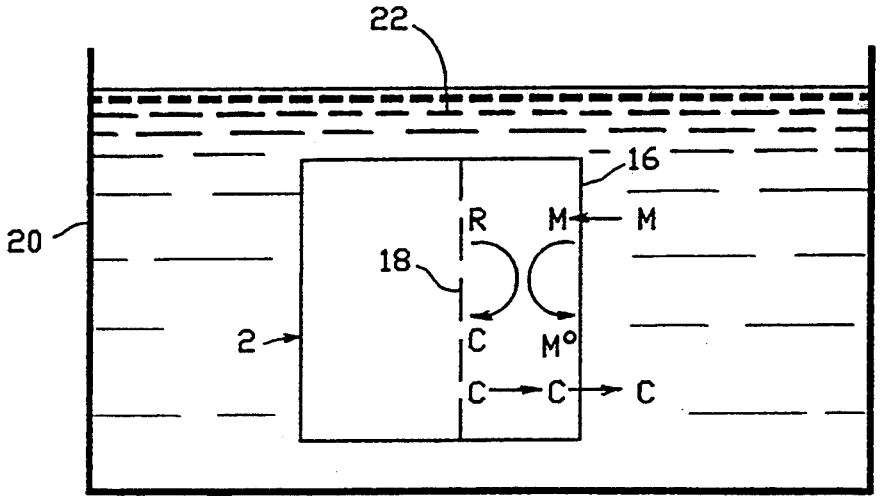
FIG. 2 schematically shows contacting the substrate of FIG. 1 with the reducing agent thereon with a solution of a species resulting in the deposition of the surface of the substrate of a reduced form of a cation.

The next step in the process is diagrammatically shown in FIG. 2. The reducing-agent-containing substrate is exposed to a solution containing a dissolved species capable of receiving at least one electron from the reducing agent at the substrate surface. The dissolved species is preferably a metal-containing compound such as metal salt or metal complex where the metal cation is represented by M in FIG. 2. The cation M receives an electron from reducing agent R to reduce the oxidation state of cation M most preferably to zero oxidation state represented by $M^0$. When the reducing agent R gives up an electron, it returns to compound C which diffuses out from surface 16 of substrate 2. The substrate 2 is placed in a container 20, containing a solution 22 containing cations M. The location of the deposit of the reduced cation $M^0$ is determined by the relationship of the flux of reducing agent from within the film to the surface 16 with the flux of cations M from the solution 22 into the surface 16. The diffusion fronts can be spatially well defined or defused depending on the environmental conditions. Where the two diffusion fronts meet, the cation M is reduced and the reducing agent is oxidized to its form C prior to electrochemical reduction. The cation M is preferably reduced to the zero oxidation state of a metal which is catalyic to electroless deposition, for example, Pd, Ag, Pt, Au, Ru, Ni, Cu, Co. On the metal seed layer, another metal can be electrolessly deposited by methods commonly known in the art. Examples of metals which can be electrolessly deposited are Au, Ag, Cu, Co, Ni, Pd. The method of the present invention can be used on polymers of any thickness. The method according to the present invention does not require complete penetration of the electrolyte or reducing agent throughout the film to achieve deposition of the cation in solution in reduced form on the surface or within the surface of the substrate. The methods of the present invention allow deposition of a diffused seed layer within the polymer matrix near the surface to provide sites for electroless plating and increased interlocking between the metal and polymer chains for enhanced adhesion. The methods according to the present invention permits simultaneous two-sided seeding and seeding of irregular surfaces and through-holes for use in printed circuit boards and packaging applications. The methods according to the present invention can be used to generate a pattern seed deposit and therefore, permit an all-additive metallization scheme or permanent resist approach. In the additive approach by methods commonly known in the art a pattern resist corresponding to the negative of the desired metal pattern can be applied to the substrate surface before seeding. Seed is deposited according to the methods of the present invention. The resist is removed leaving a pattern of the seed metal on which a metal layer can be electrolessly deposited this eliminates the need to blanket deposit the seed on the substrate and a subsequent metal etch process to remove seed between the electrolessly metal plated lines.

The electroless deposition of metal onto seed layers is commonly known in the art. A nonlimiting exemplary list of materials suitable for seed materials are Pd, Ni, Au, Ag, Pt, Ru, Co and Cu. These materials can be singly deposited or codeposited. Palladium is particularly effective as a seed material. Materials commonly used in the art for electroless deposition are metals such as copper, cobalt, palladium, nickel, silver, gold and alloys thereof. These materials can be singularly deposited or co-deposited. Copper is particularly useful and is readily electrolessly deposited. Thickness of 35 microns or more can be electrolessly deposited.

If the deposited seed layer is sufficiently continuous to carry a current, metal can be electroplated onto the seed by methods commonly known in the art. If the seed layer is not sufficiently continuous to carry a current for electroplating by methods commonly known in the art, an electroless metal can be electrolessly deposited thick enough to carry a current and metal can be electroplated thereon by methods commonly known in the art. Examples of metals which can be electroplated are Au, Ag, Au, Ag, Cu, Ni, Pd, Pt, Pb, Sn and alloys thereof.

A patterned seed layer can be deposited by first disposing onto the substrate a resist like material which does not absorb the reducing agent. The resist material is patterned exposing selected regions or the substrate, the resist coated substrate is immersed in the solution containing the reducing agent. The reducing agent is absorbed at those regions where the substrate is exposed. The substrate is then contacted with a seeding medium which disposes zero oxidation seed on those regions of the substrate where the reducing agent has been absorbed. Metal can be subsequently electrolessly or electrolytically plated onto those regions containing the seed. The resist can be removed or the resist can remain as a permanent dielectric material between the plated metal lines.

Alternatively, by the methods according to the present invention, the surface of the substrate can be seeded and the resist material can be disposed thereover and patterned by methods commonly known in the art. Metal can be electrolessly plated onto the exposed seed material on the pattern of the resist. The resist material can either be removed and the excess seed where metal has not been electrolessly deposited can be removed by methods commonly known in the art in place as a permanent resist. If the seed layer is not continuous enough to carry a current, the resist can remain.

Alternatively, by methods according to the present invention seed material can be disposed onto the surface of a substrate, a thin layer of metal can be blanket electrolessly deposited onto the seed metal to form a thin layer thick enough to carry a current. A pattern resist can be deposited and a thick metal layer electrolessly deposited into the pattern. The resist is removed and the excess seed and electroless metal, where the electrolytically deposited metal has not been deposited can be removed by methods commonly known in the art.

Substrates useful to practice the present invention can be electroactive or non electroactive. Where the substrate is electroactive it has redox sites which are capable of reversibly receiving and giving up electron. A nonelectrocative substrate does not have such sites which are capable of reversibly receiving electrons. Where the substrate is electroactive within the contemplation of the present invention, the reducing agent which is absorbed at the substrate surface is not energetically exposed to transfer electrons to the redox sites of the electroactive substrate. Those electroactive materials for which a reducing agent is energetically disposed to transfer electrons to the redox sites are described in the cross-reference application of Viehbeck et al. Therefore, the substrates useful to practice the present invention are not energetically disposed to receiving electrons from the reducing agents. A nonlimiting list of substrates useful to produce the present invention are found from ceramics, glass-ceramics, glasses, semiconductors and polymers. A nonlimiting exemplary list of polymeric materials useful to practice the present invention are polyimides, polyamides, polyamide-imides, polyolefins, such as polyethylene, polypropylene, polybutadiene, polysulfones, polycarbonates, polyethylene terephthalates, polyisophthalimides, polyacrylates, such as polymethylmethacrylates, polyacrylonitriles, polystyrene, polyesters, polysiloxanes, nitrile, ABS (acrylonitrile-butadiene-styrene) polymers, flouropolymers including tetrafluoroethylene, thermosetting polymers such as epoxy and phenolic based materials, and inorganic materials including polyphosphates, ceramics, semiconductors and zeolitic structures. The substrates can be molded articles or polymers containing fillers or reinforcing agents like glass filled epoxy.

Examples of reducing agents are benzil anion, anthraquinon anion, benzophenone anion, benzoin dianion, sodium naphthalenide and anion of N,N'-di-n-butylpyromellitimide, potassium anthracene, potassium benzophenone, anthracene anion, tetrakis (dimethylamino)ethylene.

The reducing agents can be reducing agents, per se, or produced such as in situ by electrochemical means. The reducing agents can be generated by chemical reaction such as by reacting benzoin and potassium tert-butoxide or be a compound having a strong electron donating power such as tetrakis(dimethylamino)ethylene.

Examples of suitable organic compounds that can be electrochemically reduced to provide the chemical reducing agent include, but are not limited to, the following groups of compounds: unsaturated aromatic hydrocarbons (e.g., anthracene), aldehydes and ketones (e.g., benzaldehyde, dibenzoylmethane) imides (e.g., N-n-butylphthalimide, N,N'-di-n-butyl-3,3',4,4'-biphenyl tetracarboxylic diimide), carbodiimides (e.g., bis-(p-chlorophenyl carbodiimide), aromatic heterocyclic nitrogen compounds (e.g., 9,10-diazaphenanthrene), anhydrides (e.g., 1,8-naphthalic anhydride, 3,3',4,4'-benzophenone tetracarboxylic dianhydride), quinones (e.g., 9,10-anthraquinone), quaternary aromatic nitrogen compounds (e.g., 1-ethylpyridinium bromide), azomethines (e.g., N-p-biphenylbenzalimine), immonium salts (e.g., N-ethyl-N-methyl benzophenone immonium salt), azo compounds (e.g., 4,4'-azobiphenyl), amine oxides (e.g., acridine N-oxide), nitro and nitroso compounds (e.g., 2-t-butylnitrobenzene), and organometallic compounds (e.g., dibiphenylchromium (I) iodide).

Benzil, 9-fluorenone, benzophenone and anthracene are examples of specific compounds that can be reduced to provide the chemical reducing agents suitable for carrying out the present invention. The compounds can be reduced by applying such to an electrochemical cell containing an anode and a cathode and then applying a voltage. Alternatively, the reduced species can be generated by reacting the compound with an alkali metal to form an anionic state of the compound.

The compounds can be reduced, electrochemically or by bulk electrolysis. Typically, this is done using a two-compartment cell whereby the compartments are separated by a sintered glass disk or frit having a porosity of less than 8 $\mu$m. A salt bridge or semi-permeable membrane also could be used to separated the compartments. The working compartment is housed with a cathode electrode which is comprised of a metal such as platinum, mercury, or stainless steel. The anode electrode is comprised of a conductor such as platinum, carbon, or stainless steel. For potentiostatic operation, an appropriate reference electrode is positioned in the working compartment (e.g., Ag/0.1M Ag $NO_3$). The cell can be purged with an inert gas such as $N_2$ or argon using an inlet tube and one-way valve or operation can be done in a glove box under an inert atmosphere.

Electrochemical generation of the reducing agent is accomplished by either galvanostatic, potentiostatic, or voltage-controlled electrolysis. Typically, the current density range for galvanostatic reduction is 0.1 to 2 $mA/cm^2$. In potentiostatic mode, reduction is typically done by applying a potential to the cathode which is more negative (e.g. —50 mV or more) than the reduction potential for the organic compounds as measured against the same reference electrode.

In addition, the composition used to reduce the polymer will include in the solution a supporting electrolyte and preferably a supporting electrolyte salt that contains as cation a member form one of the following groups: tetraalkylammonium, tetraalkylphosphonium, alkali metal, aryl-alkylammonium, aryl-alkylphosphonium, or chelated metal. The preferred tetraalkylammonium group is tetrabutylammonium, but other tetraalkyls with alkyl group being methyl, ethyl, propyl, isopropyl, pentyl, hexyl, or mixed alkyl thereof can be employed if desired. An example of a typical aryl group is phenyl and an arylalkylammonium is benzyltributylammonium, an example of a chelated metal cation is potassium 18-crown-6. The supporting electrolyte salt preferably contains an anion of one of the following: tetrafluoroborate, hexafluorophosphate, aryl sulfuronate, perchlorate, or halide such as bromide or iodide.

The electrolyte solution is preferably comprised of an aprotic solvent. The aprotic solvents suitable for use in this invention include, but are not limited to, the following: nitrile and nitro compounds (e.g., acetonitrile, benzonitrile, nitromethane), amide and cyclic amide compounds (e.g., N,N-dimethylformamide, N-methylformamide, N,N-diethylformamide, N-ethylformamide, N,N-dimethylacetamide, N-methyl-2-pyrrolidone, hexamethylphosphoramide, ester, cyclic ester, and ether compounds (e.g., propylene carbonate, ethylene carbonate, γ-butyrolactone, ethyl acetate, tetrahydrofuran, dimethylether), oxide and sulfo compounds (e.g., dimethylsulfoxide, acetone, liquid sulfur dioxide, sulfolane, dimethylsulfone).

The reducing agents generated electrochemically, according to the present invention, are typically neutral organic molecules which are electrochemically charged.

Compounds such as potassium tert-butoxide can react with aromatic ketones and alcohols to form anionic species. For instance, potassium tert-butoxide reacts with benzoin to form the benzoin dianion.

It has also been found, pursuant to the present invention, that tetrakis(dimethylamino)ethylene can act as a reducing agent. Tetrakis(dimethylamino)ethylene (TKDE) is represented by the formula:

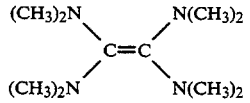

The TKDE can be used as such or employed in solution with an organic solvent including the aprotic solvents discussed above. Also, protic solvents such as water and alcohols including methanol, ethanol, and ethylene glycol can be used provided such are made alkaline (e.g. —adding a base). The TKDE reduces sites of the polymeric material to, for example, the radical anion-form while it is concurrently oxidized to a cation Form. The TKDE cations function as counter-species to balance the charge imparted to the polymer in order to maintain electroneutrality throughout the polymer. The oxidized TKDE (cation) can subsequently be regenerated to neutral TKDE, for example, by reductive electrolysis. This material can function as the solvent and counter-ions in addition to its reducing agent function.

The substrate, which after being sorbing reducing agent within a region near the exposed surface, can then be exposed to a solution of the metal ion in order to provide the metallic sites or seeds for subsequent metallic plating.

In particular, the solution can contain a cation of the desired metal such as palladium, platinum, silver, gold, copper, cobalt, and nickel will contact the reducing agents sorbed at the substrate surface. The reducing agent will thereby transfer electrons to the cation to reduce it to metal atoms in the zero oxidation state.

The deposit of the metal can be continuous (i.e., electrically conductive), but is preferably a non-continuous deposit which is on the surface or preferably embedded within the surface of the substrate to a limited depth below the substrate surface. It is important that the depth below the surface of the substrate at which the metallic deposit is present be limited so as to provide enhanced adhesion with the subsequent metallic coating on the substrate. Subsequent metallic plating within the substrate surface initiated at the embedded metallic sites or seeds introduces interpenetration of the metal deposit and substrate to enhance the adhesion through a mechanical interlocking or the formation of metallic "roots" to anchor the surface metallization to the substrate. In particular, the deposit should desirably be no greater than about 200 Ångstroms below the surface of the substrate, preferably no greater than about 800 Ångstroms and most preferably be no greater than about 200 Ångstroms. The minimum depth below the surface for enhanced adhesion is usually about 30 Ångstroms.

The density of reducing agent and the depth of penetration of the reducing agent with the substrate surface depends on the rate of solvent absorption by the substrate, temperature, the concentration and mobility of the counter ions through the substrate, the concentration and reducing potential of the reducing agent, the physical surface and time for exposing the substrate to the reducing solution.

The depth to which the metal cations will migrate into the polymer depends upon the concentration of the cation in the solution, the mobility and diffusion rate of the cation throughout the substrate and the depth to which the reducing agent penetrates the substrate, the time for exposing the substrate to the solution and the rate of electron transfer between reducing agent and cation. The rate of cation reduction mediated through previously reduced metal may be different than transfer between reducing agent and cation and, if faster, can catalyze reduction of metal at previously deposited metallic atoms or clusters.

The amount of metal deposited depends on the amount of reducing agent sorbed at the substrate surface. A surface which is lightly sorbed with reducing agent (>5 minutes in reduction bath) can result in a continuous metal layer. The continuous metal layer can then be used to further deposit metal by electrolytic means without requiring an electroless plated strike layer.

The optimum process parameters can be readily determined by persons skilled in the art once aware of the present disclosure. The operations of this invention can be done at any temperature convenient for use with the solvent under an inert atmosphere, such as a blanket of nitrogen, argon, neon, helium, or hydrogen, the preferred being room temperature and nitrogen.

EXAMPLES

Example 1

An electrolyte reducing solution comprised of 0.05M anthracene (An) plus 0.1M tetrabutylammonium tetrafluoroborate (TBAFB) in 500 ml of N,N-dimethylformamide (DMF) was electromechanically reduced in a nitrogen glove box. The electrolysis was discontinued after 15% of the anthracene was converted to the radical-anion form. A sample of glass-filled epoxy (FR-4) material 2 inch×4 inch×⅛ inch thick was immersed in reducing solution for 5 minutes, then air dried. The sample was then immersed in a solution of 5 mM $PdCl_2$ in DMF 3 minutes, then rinsed with acetonitrile and then dried. Next, the sample was placed in an electroless copper plating bath having the following composition: 15.6 gm $CuSo_4$, 60 gm Rochelle salt, 22 gm NaOH, 20 mg Gafac-RE-610, and 1 liter $H_2O$. The sample was plated for 15 minutes, then rinsed with water and dried. A continuous electrically conductive Cu metal deposit was formed on the epoxy surface.

Example 2

An electrolyte reducing solution comprised of 0.05M benzophenone (Bp) plus 0.1M tetraethylammonium tetrafluoroborate (TEAFB) in 500 ml of N-methyl-2-pyrrolidinone (NMP) was electromechanically reduced in a nitrogen glove box. The electrolysis was discontinued after 15% of the benzophenone was converted to the radical-anion form. A sample of glass-filled epoxy (FR-4) material 2 inch×4 inch×⅛ inch thick was immersed in reducing solution for 5 minutes. The sample was then immersed in a solution of 5 mM $PdCl_2$ in DMF for 3 minutes, then rinsed with acetonitrile and then dried. Next, the sample was placed in an electroless copper plating bath having the following composition: 15.6 gm $CuSo_4$, 60 gm Rochelle salt, 22 gm NaOH, 20 mg Gafac-R,E-610, and 1 liter $H_2O$. The sample was plated for 15 minutes, then rinsed with water and dried. A continuous electrically conductive Cu metal deposit was formed on the epoxy surface.

Example 3

A sample of reinforced polyester dicyanate material (Interez®) processed as described in Example 1 resulted in the formation of continuous Cu metal deposit on the substrate surface.

Example 4

A sample of reinforced polyesterdicyanate material (Interez®) processed as described in Example 2 resulted in the formation of a continuous Cu metal deposit on the substrate surface.

Example 5

A sample was prepared as described in Example 1. This sample was then electrolytically Cu plated using an acidic copper sulfate plating solution to a final thickness of 1 mil. Two millimeter wide lines were subetched into the Cu film for 90° peel testing. An average peel value of 5.8 lb/inch (minimum 4.8 lb/inch) was obtained.

Example 6

A reducing agent solution is prepared by adding 0.045M freshly cut sodium metal (thoroughly rinsed with anhydrous THF solvent) to an anthracene/THF solution resulting in the characteristic blue color of the anthracene radical-anion. This is solution is kept stirring for 24 hours before used as a reducing bath. A sample of FR-4 measuring 4 inch×6 inch×⅛ inch is immersed in the sodium anthracide (radical-anion salt) solution for 5 min, then rinsed with THF and Pd seeded as in Example 1. Highly reflective, electrically continuous electroless Cu film is formed on the FR-4 surface by plating as described in Example 1. A sample of FR-4 is Pd seeded as described in Example 1. A solvent developable resist is applied, exposed and developed into a patterned layer on the Pd seeded FR-4 substrate. The resist patterned substrate is then immersed into an electroless Cu plating solution as described in Example 1. A Cu deposit formed and plated onto the FR-4 surface which was not covered by the resist film. In this manner, a patterned Cu deposit was obtained. The resist film was then removed leaving a patterned Cu circuit features which were electrically isolated from adjacent features.

It is to be understood that the above-described embodiments are simply illustrative of the principles of the invention. Various other modifications and changes may be devised by those of skill in the art which will embody the principles of the invention and fall within the spirit and scope thereof.

Having thus described the present invention, we claim as new and desire to secure by Letters Patent is:

1. A method for conditioning a location on surface of a substrate comprising:

providing at said location from the exterior of said substrate an anionic chemical reducing agent;

sorbing said anionic chemical reduce agent at said location;

thereafter contacting said location with a solution that contains cations, said cations receiving electrons from said anionic chemical reducing agent to reduce said cations to a species of a lower valent oxidation state positioned in the interior of said substrate at a distance of no greater than about 800 Å from said surface;

said cations being selected from the group consisting of palladium, platinum, ruthenium, silver, gold, copper, nickel, cobalt, tin and combinations thereof.

2. The method of claim 1, wherein said lower valence oxidation state is a zero valent metal atom and further including depositing electroless metal from an electroless plating bath onto said zero oxidation state atom.

3. The method of claim 1, wherein said anionic chemical reducing agent is not capable of transferring electrons to said substrate.

4. The method of claim 1, wherein said substrate is a material selected from the group consisting of a polymer, a glass, a ceramic, a glass ceramic, a semiconductor and a metal.

5. The method of claim 4, wherein said polymer is selected from the group consisting of thermosetting resin, a thermo plastic resin, an epoxy based material, an esterdicyanate polymer material, polyimide, polyamides, polyetherimides, polyethersulfones, polyphenylene sulfide, polyamide-imides, polyolefens, polysulfones, polycarbonates, polyethylene-terephthalates, polyisothalimides, polyacrylates, polyester, polysiloxanes, nitrile rubbers, ABS polymers, fluoropolymers, and liquid crystal polymers.

6. The method of claim 1 wherein said anionic chemical reducing agent is at a depth no greater than 2000 angstroms below said surface.

7. The method of claim 1 wherein said anionic chemical reducing agent is at a depth no greater than 800 angstroms below said surface.

8. The method of claim 1 wherein said anionic is a depth no greater than 200 angstroms below said surface.

9. The method of claim 1, further including providing said solution in an electrolyte cell including an electrolyte an anode electrode, and a cathode electrode;

said solution containing a compound capable of receiving electrons from said cathode electrode to form said anionic reducing agent from said compound.

10. The method of claim 9, further including contacting said location with said reducing agent sorbed thereat with a species capable of receiving an electron from said reducing agent, a reduced form of said species being disposed at said surface.

11. The method of claim 10, wherein said species is a metal cation and wherein said reduced form of said species is zero valent oxidation state of said metal cation.

12. The method of claim 10, wherein said ion is a cation of a metal which selected from the group of palladium, platinum, ruthenium, silver, gold, copper, nickel, cobalt and tin.

13. The method of claim 9, wherein said substrate is material selected from the group consisting of a polymer, a glass, a ceramic, a glass-ceramic, a semi-conductor and a metal.

14. The method of claim 13, wherein said polymer is selected from the group consisting of a thermosetting resin, a thermoplastic resin, an epoxy based material, an esterdicyante polymer material, polyimide, polyamides, polyamide-imides,, polyolefins, polysulfones, polycarbonates, polyethylene, polyethermides, polyethersulfones, polyphenylene sulfide, terephthalates, polyisothalimides, polyacylates, polyesters, polysiloxanes, nitrile rubbers, ABS polymers, fluropolymers.

15. The method of claim 9, wherein said compound is selected from at least one of the group consisting of: unsaturated aromatic hydrocarbons, aromatic carbonyl compounds, imides, diimides, carbodiimides, anhydrides, quinones, quaternary aromatic nitrogen compounds, aromatic heterocyclic nitrogen compounds, azomethines, immonium salts, azo compounds, amines oxides, nitro and nitroso compounds and organometallic compounds.

16. The method of claim 9, wherein said reducing agent is selected from one or more of the group consisting of: benzoin dianion, benzil anion, anthracene anion, dibezoylmethane radical anion, benzophenone anion, anthraquinone anion, 9-fluorenone anion, N-n-butylphthalimide anion, N,N'-di-n-butyl-3,3,'4,4,'-biphenyltetracarboxylic diimide anion, N,N,'-di-n-butylpyromellitic diimide anion, acridine anion, and 1-azafluoroanthene anion.

17. The method of claim 9, wherein said reducing agent is generated from a neutral organic compound whereby all or a portion of said neutral organic compound has been chemically reduced in an aprotic solvent by reaction with an alkali metal.

18. The method of claim 1, wherein said agent is generated from a neutral organic compound whereby all or a portion of said neutral organic compound has been electrochemically reduced in said electrolyte containing an aprotic solvent.

19. The method of claim 18, wherein said electrolyte contains a cation which is at least one member of the group of tetraalkylammonium, tetraalkylphosphonium, alkali metal, mixed alkyl-aryl ammonium, mixed alkyl-aryl phosphonium, or chelated metal and said supporting electrolyte salt anion is at least one member selected from the group of tetrafluoroborate, hexafluorophosphate, perchlorate, halide, aryl sulfonate, and aromatic organic compounds.

20. The method of claim 18, wherein said aprotic solvent is at least one member selected from the group of nitriles, nitro compounds, amides, cyclic amides, amines, esters, cyclic esters, ethers, carbonates, oxides and sulfo compounds.

21. The method of claim 1, wherein said cation is contained in a metal cation compound.

22. A method for conditioning a location on a surface of a substrate comprising:

providing at said location an anionic chemical reducing agent;

thereafter contacting said location with a solution than contains cations, said receiving electrons from said anionic chemical reducing agent to reduce said cations to a species of a lower valent oxidation state positioned in the interior of said substrate at a distance of no greater than 800 Åfrom said surface;

said cations being selected from the group consisting a palladium, platinum, ruthenium, silver, gold, copper, nickel, cobalt, tin and combinations thereof; and said anionic chemical reducing agent is selected from the group consisting of unsaturated aromatic hydrocarbons, aromatic carbonyl compounds, imides, diimides, carbodiimides, anhydrides, quinones, quaternary aromatic nitrogen compounds, aromatic heterocyclic nitrogen compounds, azomethines, immonium salts, azo compounds, amines oxides, nitro and nitroso compounds and organo metallic compounds.

23. A method for conditioning a location on a surface of substrate comprising:

providing at said location an anionic chemical reducing agent;

thereafter contacting said location with a solution that contains cations, said cations receiving electrons from said anionic chemical reducing agent to reduce said cations to a species of a lower valent oxidation state positioned in the interior of said substrate at a distance of no greater than about 800 Å from said surface;

said cations being selected from the group consisting of palladium, platinum, ruthenium, silver, gold, copper, nickel, cobalt, tin and combinations thereof; and said anionic chemical reducing agent is selected from the group consisting of benzion dianion, benzil anion, anthracene anion, dibenzoylmethane radical anion, benzophenone anion, anthraquinone anion, 9-fluorenone anion, N-n-butylphthalimide anion, N,N'-di-n-butyl-3,3',4,4'-biphenyltetracarboxylic diimide anion, N,N'-di-n-butylpyromellitic diimide anion, acridine anion, and 1-azafluoroanthene anion.

24. A method for conditioning a location on a surface of a substrate comprising:

providing at said location an anionic chemical reducing agent; thereafter contacting said location with a solution that contains cations, said cations receiving electrons from said anionic chemical reducing agent to reduce said cations to a species of a lower valent oxidation state positioned in the interior of said substrate at a distance of no greater than about 800 Åfrom said surface;

said cations being selected from the group consisting of palladium, platinum, ruthenium, silver, gold, copper, nickel, cobalt, tin and combinations thereof; and said anionic chemical reducing agent is generated from a neutral organic compound whereby all or a portion of said neutral organic compound has been chemically reduced in an aprotic solvent by reaction with an alkali metal.

25. A method for conditioning a location on a surface of a substrate comprising:

providing at said location an anionic chemical reducing agent;

thereafter contacting said location with a solution that contains cations, said cations receiving electrons from said anionic chemical reducing agent to reduce said cations to a species of a lower valent oxidation state positioned in the interior of said substrate at a distance of no greater than about 800 Åfrom said surface;

said cations being selected from the group consisting of palladium, platinum, ruthenium, silver, gold, copper, nickel, cobalt, tin and combinations thereof; and said anionic chemical reducing agent is generated from a neutral organic compounds whereby all or a portion of said neutral organic compound has been electrochemically reduced in an aprotic solvent containing a supporting electrolyte salt.

26. The method of claim 25, wherein said supporting electrolyte salt contains a cation which is selected from the group consisting of tetraalkylammonium, tetraalkylphosphonium, alkali metal, mixed alkyl-aryl ammonium, mixed alkyl-aryl phosphonium, and chelated metal and an anion which is selected from the group consisting of tetrafluoroborate, hexafluorophosphate, perchlorate, halide, aryl sulfonate and aromatic organic compounds.

27. The method of claim 25 wherein said supporting electrolyte salt contains at least one member selected from the group of tetrabutylammonium tetrafluoroborate, tetraethylammonium tetrafluoroborate, tetrabutylammonium hexafluorophosphate, tetraethylammonium bromide, lithium tetrafluoroborate, lithium perchlorate, benzyltributylammonium tetrafluoroborate, and sodium naphthalenide.

28. The method of claim 25 wherein said aprotic solvent is at least one member selected from the group of nitriles, nitro compounds, amides, cyclic amides, amines, esters, cyclic esters, carbonates, oxides and sulfo compounds.

29. A method for conditioning a location on a surface of a substrate comprising:

providing at said location an anionic chemical reducing agent;

thereafter contacting said location with a solution that contains cations, said receiving electrons from said anionic chemical reducing agent to reduce said cations to a species of a lower valent oxidation state positioned in the interior of said substrate at a distance of no greater then about 800 Å from said surface;

said cations being selected from the group consisting of palladium, platinum, ruthenium, silver, gold, copper, nickel, cobalt, tin and combinations thereof; and said surface is patterned with a resist coating act as a mask and thereby expose specific areas of said surface to said reducing agent and thereby depositing zero valent atoms only in the exposed areas.

30. The method of claim 29 wherein the said resist is removed by dissolution, leaving a two-dimensional metal pattern remaining on said surface.

31. A method of conditioning at least one surface of a substrate comprising:

sorbing at said at least one surface an anion chemical reducing agent selected from the group consisting of: benzoin dianion, benzil anion, anthracene anion, dibenzoylmethane radical anion, benzophenone anion, anthraquinone anion, 9-fluorenone anion, N-n-butylphthalimide anion, N,N'-di-n-butyl-3,3'4,4'-biphenyltetracarboxylic diimide anion, N,N'-di-n-butylpyromellitic diimide anion, acridine anion, and 1-azafluoranthene anion;

contacting said at least one surface with a solution than contains metal cations, said cations receiving electrons from said anionic chemical reducing agent to reduce said cations to metal in the zero oxidation state; and electrolessly depositing metal onto said metal in the zero valent oxidation state.

32. A method for conditioning a location on a surface of a substrate comprising:

providing at said location an anionic chemical reducing agent;

thereafter contacting said location with a solution than contains cations, said cations receiving electrons from said anionic chemical reducing agent to reduce said cations to a species of a lower valent oxidation state positioned in the interior of said substrate at a distance of no greater than about 800 Å from said surface;

said cations being selected from the group consisting of palladium, platinum, ruthenium, silver, gold, copper, nickel, cobalt, tin and combinations thereof;

said anionic chemical reducing agent is generated from a neutral organic compound whereby all or a portion of said neutral organic compound has been electrochemically reduced in said electrolyte containing an aprotic solvent; and said solution contains an electrolyte selected from the group of tetrabutylammonium tetrafluoroborate, tetraethylammonium tetrafluoroborate, tetrafluoroborate, hexafluorophosphate, tetraethylammonium bromide, lithium tetrafluoroborate, lithium perchlorate, benzyltriburylammonium tetrafluoroborate and sodium naphthalenide.

33. A method for conditioning a location on a surface of a substrate comprising:

providing at said location tetrakis (dimethylamino)ethylene as a chemical reducing agent;

thereafter contacting said location with a solution than contains cations, said cations receiving electrons form said anionic chemical reducing agent to reduce said cations to a species on a lower valent oxidation state.

* * * * *